US011013941B2

(12) United States Patent
Teiner

(10) Patent No.: US 11,013,941 B2
(45) Date of Patent: May 25, 2021

(54) DEVICE FOR PREVENTING PERSONS FROM FALLING

(71) Applicant: POHL DWS GmbH, Duren (DE)

(72) Inventor: Nils Teiner, Munster (DE)

(73) Assignee: POHL DWS GmbH, Duren (DE)

( * ) Notice: Subject to any disclaimer, the term of this patent is extended or adjusted under 35 U.S.C. 154(b) by 49 days.

(21) Appl. No.: 16/475,896

(22) PCT Filed: Jan. 10, 2018

(86) PCT No.: PCT/EP2018/050532
§ 371 (c)(1),
(2) Date: Sep. 4, 2019

(87) PCT Pub. No.: WO2018/130553
PCT Pub. Date: Jul. 19, 2018

(65) Prior Publication Data

US 2020/0164237 A1 May 28, 2020

(30) Foreign Application Priority Data

Jan. 10, 2017 (DE) ..... 10 2017 100 373.8

(51) Int. Cl.
*A62B 35/00* (2006.01)
*A62B 35/04* (2006.01)
*E04G 21/32* (2006.01)

(52) U.S. Cl.
CPC ..... *A62B 35/0068* (2013.01); *A62B 35/04* (2013.01); *E04G 21/328* (2013.01); *E04G 21/329* (2013.01)

(58) Field of Classification Search
CPC . A62B 35/04; A62B 35/0068; E04G 21/3276; E04G 21/329; E04G 21/328
See application file for complete search history.

(56) References Cited

U.S. PATENT DOCUMENTS 3,157,256 A * 11/1964 Latta, Jr. ..... E02D 5/80 52/166
7,665,248 B2 * 2/2010 Blackford ..... E04D 13/12 52/27

(Continued)

FOREIGN PATENT DOCUMENTS

CH 104527 A1 8/2012
CH 704527 A1 * 8/2012 ..... A62B 35/0068

(Continued)

OTHER PUBLICATIONS

International Search Report dated Feb. 20, 2018, International application No. PCT/EP2018/050532.

*Primary Examiner* — Eret C McNichols
(74) *Attorney, Agent, or Firm* — Dinsmore & Shohl LLP

(57) ABSTRACT

The invention relates to a device for preventing persons from falling, in particular from a roof, comprising a foot plate (10) which can be secured to an underlying surface and which comprises a stop point that can be attached to the foot plate, comprising either a post which projects upwards from the foot plate and which comprises an eyelet arranged in the upper end region of the post or an eyelet which can be introduced directly into the foot plate, in each case for attaching a cable by means of which the person is prevented from falling. According to the invention, a foot plate central region, in which the post or the eyelet is connected to the foot plate, is slotted around the post or the eyelet along at least one first defined circumferential slotted line (18*a*), which extends over at least approximately 270° in the circumferential direction, such that the central region is connected to the rest of the peripheral region of the foot plate (10) solely via narrow material webs (18*b*). In the event of a load, a type of joint is produced along the foot plate (10) sheet webs remaining between the slots, and the central region lying within the circumferential slotted line pivots (Continued)

together with the posts secured to the region upwards out of the plane of the footplate on the basis of the lifting force acting via the posts. The posts can thus lie flatly, and a torque is no longer acting on the peripheral region of the foot plate.

12 Claims, 8 Drawing Sheets

(56) References Cited

U.S. PATENT DOCUMENTS

| | | | | |
|---|---|---|---|---|
| D646,553 | S * | 10/2011 | Peng | D8/349 |
| 8,550,225 | B2 * | 10/2013 | Blomberg | A62B 35/04 188/371 |
| 9,233,585 | B1 * | 1/2016 | Haynes | B60D 1/18 |
| 10,232,201 | B2 * | 3/2019 | Wells | A62B 35/0068 |
| 10,710,531 | B2 * | 7/2020 | Abushawashi | F16F 7/12 |
| 10,737,126 | B1 * | 8/2020 | Aleksovski | E04G 21/3276 |
| 2007/0144830 | A1 * | 6/2007 | Mastenbroek | A62B 35/04 182/3 |
| 2009/0133977 | A1 * | 5/2009 | Warren | F16F 7/14 188/371 |
| 2009/0194366 | A1 | 8/2009 | Parker et al. | |
| 2013/0168528 | A1 * | 7/2013 | Patton | F16F 7/126 248/548 |
| 2013/0277519 | A1 * | 10/2013 | Poldmaa | A62B 35/0068 248/237 |
| 2014/0251724 | A1 * | 9/2014 | Nichols, Jr. | A62B 35/0068 182/3 |
| 2014/0346314 | A1 * | 11/2014 | Poldmaa | A62B 35/0075 248/636 |
| 2018/0264297 | A1 * | 9/2018 | Poldmaa | A62B 35/0068 |
| 2019/0314656 | A1 * | 10/2019 | Farrell | A62B 35/04 |

FOREIGN PATENT DOCUMENTS

| | | | | |
|---|---|---|---|---|
| CH | 704527 | A1 | 8/2012 | |
| DE | 102006041592 | A1 | 5/2007 | |
| DE | 102012102476 | A1 | 9/2013 | |
| EP | 2447444 | A1 * | 5/2012 | E04G 21/329 |
| EP | 2447445 | A1 | 5/2012 | |
| EP | 2578775 | A1 | 4/2013 | |
| EP | 3741928 | A1 * | 11/2020 | E04G 21/3276 |
| WO | 2009008706 | A2 | 1/2009 | |
| WO | 2012177675 | A2 | 12/2012 | |
| WO | 2012177676 | A1 | 12/2012 | |
| WO | 2015059080 | A1 | 4/2015 | |
| WO | WO-2019158763 | A1 * | 8/2019 | E04G 21/3276 |

* cited by examiner

DEVICE FOR PREVENTING PERSONS FROM FALLING

CROSS-REFERENCE TO RELATED APPLICATIONS

This application is the U.S. national stage of PCT/EP2018/050532 filed Jan. 10, 2018, which claims priority of German Patent Application 10 2017 100 373.8 filed Jan. 10, 2017 of which is hereby incorporated by reference in its entirety.

BACKGROUND OF THE INVENTION

The present invention relates to a device for preventing persons from falling, in particular from a roof, comprising a foot plate being fixable to an underlying surface, having a stop point that can be attached to the foot plate, comprising either a post projecting upwards from said foot plate, having an eyelet arranged in the upper end region of the post, or an eyelet that can be attached directly at said foot plate, in each case for fixing a cable or by way of direct attachment to a cable system, which protects the person from falling, wherein a central region of the foot plate, in which said post or said eyelet is connected with said foot plate, is slotted around said post or said eyelet along at least one first defined circumferential slotted line, which extends over at least approximately 270° in the circumferential direction, such that the central region is connected with the remaining peripheral region of said foot plate solely via narrow material webs.

Fall protection devices of the afore-mentioned kind are well-known from the prior art and are used in particular for protecting persons, who work on flat roofs. Basic requirements of such kind of a fall protection device, especially as to their resilience, are stipulated in the DIN EN 795, the content of which is herewith referred to.

A fall protection device with a foot plate and a post projecting upwards is for example also disclosed in DE 10 2006 041 592 A1. In case of the present as well as of similar devices known from the prior art, the post projecting upwards, which is placed onto the foot plate, is for example a steel pipe having an eyelet at its upper end. Fall protection devices of this kind have to be equipped for two load cases. One of the load cases is protecting the post against impact, when a person working on the roof accidently hits against the post. Basically, in case of a laterally acting impact force of 70 kg, a predetermined deformation value of for example 10 mm may not be exceeded. Different from this case is the second actual load case of the fall protection device, according to which the device has to resist a lateral force of 1.2 t, in order to absorb the tensile load generated via the cable fixed at the eyelet when a person falls from the roof.

If a post is provided on the foot plate according to the known device, the tensile load acts via the eyelet arranged at the upper end of the post, onto the post in a lateral direction, which produces a moment, thus practically generating a leverage, which causes the foot plate to tear out of the anchor at the roof supporting construction in the area of the foot plate.

DE 20 2012 102 476 U1 discloses a device for protecting persons from falling, which is rather applicable in case of such loads being generated in the second above-mentioned load case. Furthermore, in case of this known device, the connection between post and foot plate is designed as a desired breakage connection which disengages in a crash case, wherein inside the post, a metal cable connection is provided which forms a tension-resistant connection of the eyelet in an anchoring area of the device. This known solution can readily deal with the first load case, as the post can be arranged in a way that in case of an impact of for example up to 70 kg, it does not bend more than provided in the requirements. In the second mentioned load case, the post made of plastic is practically sacrificed.

Arranging the above-mentioned foot plates, to which the stop point for the fall protection device is attached, onto flat roofs with trapezoidal metal sheets, causes a particular problem. In such cases, the roof construction exclusively consists of two trapezoidal sheets, between which an insulating layer is provided, wherein the upper trapezoidal sheet is connected with the insulating layer merely by means of an adhesive bond. In case of screwing a foot plate onto the upper trapezoidal sheet, a torque being introduced via the post into the foot plate in case of a fall generates a peel force and the trapezoidal sheet which is held only by adhesion, will tear off together with the foot plate. For this reason, using the known fall protection devices for such flat roof constructions with bonded trapezoidal metal sheets is not allowed.

From the prior art, several fall protection devices have become known, where it is tried in a crash case to convert a portion of the tensile forces acting onto the fall protection device, into deformation work and thus to practically slow down the fall. This is for example the case for the devices described in EP 2 447 445 A1, CH 704 527 A1 and WO 2009/008706 A2. Particularly in case of the solution according the last mentioned document, the distance of a desired breakage line, along which a plate-shaped area tears off up to the attachment point, is considerably extended. In this case, the desired breakage line extends in a spiral manner.

DE 10 2006 041 592 A1 discloses a fall protection device, according to which a rod projecting from a foot plate is provided, wherein the foot plate is attached on a trapezoidal metal sheet of the roof construction. In a crash case, the lever arm formed by the rod is extended by the foot plate, such that an increased torque is produced. This increases the forces acting upon the roof construction and the trapezoidal sheet of the roof construction is considerably deformed in large areas, which afterwards requires an extensive restoration of the roof construction.

The object of the present invention is thus to provide a device for preventing persons from falling, comprising the features of the initially mentioned kind, wherein the lever arm is shortened in the crash case, the torque is minimized and thus, damages to the roof constructions are avoided or at least considerably reduced.

SUMMARY OF THE INVENTION

The invention provides that in addition to the first circumferential slotted line extending over approximately 270° in the circumferential direction, another approximately straight slotted line is arranged, each time in a distance between the respective ends of the first circumferential slotted line, wherein the mentioned distance between the first circumferential slotted line and the other straight slotted line corresponds to the width of said narrow material webs.

In the second mentioned load case, in which the actual securing function against falling is concerned, a kind of joint is generated along the webs of the metal sheet of said foot plate which were left off between the slots, and due to the leverage acting via said post or said eyelet, the central region located within the circumferential slotted line pivots together with said post attached to said area out of the plane of the footplate upwards. In this way, the post can be tilted down and no moment acts on the peripheral region of said foot plate. Thus, said footplate is not stressed but remains in its position, such that even the trapezoidal sheet connected with the foot plate will not disengage. Therefore, the central region of the foot plate which pivots together with the post out of the plane, is here also described as pivoting area. As no more moment is applied onto said foot plate, this is no longer levered out by the post, as in case of earlier solutions. Rather exclusively that tensile load generated by the fall, acts via the cable connection in horizontal direction onto the remaining peripheral regions of said foot plate or its anchoring in the underlying surface/at the roof construction. These are configured for the tensile load according to the requirements (in Rule 1.2 t Transverse force) and cannot tear off.

As compared to the above-mentioned prior art, the solution according to the invention provides that the laying down of said post is realized near the roof surface, which avoids that the lever arm forming the post is extended by parts of the foot plate, which would increase the torque. Said post already tears off at its foot, at the desired breakage connection provided there.

The other straight slotted line narrows the region of the left off material and generates a joint, such that the tilting of said post around the desired turning point of this joint is facilitated. The measure according to the invention reduces the lever arm and prevents damages to the roof construction in a crash case.

According to a preferred embodiment of the solution according to the invention it is provided that in a radial distance within said first defined circumferential slotted line, at least one second circumferential slotted line with a smaller diameter is arranged, the shape of which is geometrically similar to said first circumferential slotted line, wherein in a plan view, however, said second circumferential slotted line is arranged by approximately 90° or approximately 180° offset to said first circumferential slotted line.

Preferably, in a radial distance within said second defined circumferential slotted line, at least one third circumferential slotted line with a smaller diameter is arranged, the shape of which is geometrically similar to said first circumferential slotted line, wherein in a plan view, however, said third circumferential slotted line is arranged by approximately 90° or approximately 180° offset to said first circumferential slotted line and/or to said second circumferential slotted line.

Preferably, in a radial distance within said third defined circumferential slotted line, at least one fourth circumferential slotted line with a smaller diameter is arranged, the shape of which is geometrically similar to said third circumferential slotted line, wherein in a plan view, however, said fourth circumferential slotted line is arranged by approximately 90° or approximately 180° offset to each of said first circumferential slotted line and/or to said second circumferential slotted line. In case of this preferred embodiment, thus, in total four circumferential slotted lines are present and thus, four central regions, being separated via said circumferential slotted line from the respective peripheral region of the foot plate surrounding the respective circumferential slotted line. Said four circumferential slotted lines are each arranged inside one another and are preferably geometrically similar to one another. As said circumferential slotted lines are each arranged by 90° or even 180° offset to one another, for each possible direction in which the force acts during a crash, a corresponding pivoting area is provided, which pivots upwards together with the laying down post and in this way unloads the remaining peripheral region of the foot plate.

In this case it is unimportant that the surfaces of the respective pivot ranges, as they are arranged inside one another, have different sizes. The left-off webs of said foot plate between the slots can each have approximately the same length for all four pivot ranges, in spite of the circumferential slotted lines of differing lengths, which makes it unimportant, from which direction the force acts, because the connection between the pivot range pivoting upwards in the crash case and the peripheral area of said foot plate remaining in the horizontal plane of the flat roof thus each time has the same strength and can thus each time withstand the same load. If said force is applied from a diagonal direction in case of pivot ranges being offset to one another by approximately 90°, which means not approximately parallel to one of the outer edges of the foot plate, possibly two of the pivot ranges will act simultaneously, in a way that in this case the corresponding unload effect is also achieved.

Said foot plate itself is preferably attached to the underlying surface in a manner known per se by means of at least one screwed connection or rivet connection. In case of the succeeding second load case (crash case), the tensile load is introduced via the securing cable and the metal cable connection directly into the connections of the foot plate. Said metal cable connection can for example comprise a cable made of stainless steel. Such cable is corrosion-resistant and if having a diameter of for example 6 mm, it can absorb the required tensile force of more than one ton without any problems.

A preferred embodiment of the present invention provides that to each of said second circumferential slotted line and/or said third circumferential slotted line, a further, approximately straight slotted line is aligned, each of which is arranged in a distance between the respective ends of the respective circumferential slotted line, wherein said distance between the respective ends of the respective circumferential slotted line and the respective straight slotted line does never correspond to the respective width of the left off narrow material webs. Thus, in this case, a separation in the region of the circumferential slotted line and in the region of the straight slotted line is given, such that in the load case, the connection between the pivot range and the peripheral region remaining in the plane of the foot plate is only given through said narrow material webs. These are, however, configured in a way that they can absorb the generated tensile forces.

Here, naturally, the material strength of said foot plate is of importance, which is preferably in a range of approximately 1 to 8 mm, for example in the range of approximately 3 to 5 mm.

According to a preferred embodiment of the present invention, said first and/or said second and/or said third and/or said fourth circumferential slotted line have approximately the shape of the Greek letter Omega.

Furthermore, it is preferred that the shape of said first and/or said second and/or said third and/or said fourth circumferential slotted line is defined by a sequence of lined-up, straight sub sections, each of which being disposed at an angle to one another, according to the principle of Mohr's circle of stress. This shape has proved to be especially advantageous in several tests. The afore-mentioned shape similar to an omega does in this case not consist of a curved line, but of a number of straight sub-sections being disposed at an angle to one another, wherein this shape is in total similar to the shape of an omega.

According to the present invention, said circumferential slotted lines and said straight slotted lines can preferably be inserted into the foot plate by means of laser beam or high-pressure water jet. This method allows producing a very precise shape of the slotted line having a very small slot width, wherein even separating a metal sheet of said foot plate with a thickness of some mm is possible without any problems. The slot width can have for example only fractions of one millimeter, wherein, however, said slot may not be too narrow, such that in the load case, the pivot range can be pivoted upwards without any problems and a jamming within the slot region cannot occur.

Usually, the foot plate of said fall protection is screw-connected or riveted with the roof construction, i.e. with said trapezoidal metal sheet. The post or the eyelet of said fall protection are preferably screw-connected with said foot plate. For this purpose, for example said post or said eyelet can have an outer thread in an end region facing the roof construction, and said post or said eyelet can then be attached at the foot plate by means of a nut to be screwed onto said outer thread.

The features mentioned in the sub-claims are related to preferred embodiments of the solution according to the invention. Further advantages of the invention become obvious from the following detailed description.

BRIEF DESCRIPTION OF THE DRAWINGS

In the following, the present invention is described in more detail according to exemplary embodiments under reference to the accompanying drawings:

FIG. 7 a shows a corresponding view of the embodiment of FIG. 7, wherein after the load case has occurred, the eyelet is with the pivot range of the foot plate pivoted into the horizontal position.

DETAILED DESCRIPTION OF THE DRAWINGS

Subsequently, it is firstly referred to FIG. 1 which shows a simplified schematic view of a part of a fall protection device according to the invention. This comprises an in its shape for example approximately rectangular, however in parts rounded foot plate 10 being connected with a trapezoidal metal sheet of the roof construction, not shown here, for example by screwed connections. For this purpose, the foot plate has screw or rivet holes 11 arranged in lines for example in outer edge regions. In this way, such a foot plate 10 of the fall protection device, lying onto a trapezoidal metal sheet, is firmly connected with it. The foot plate 10 can for example be a metal sheet made of stainless steel, having a thickness of approximately 3 to 4 mm. In the center of the foot plate 10, within the innermost pivot range, there is a through hole 12, through which a screw thread can be inserted, being arranged at the lower end of a post of the fall protection device, such that the post can be tightened via a lock nut on the underside of the foot plate 10.

Figure 1:
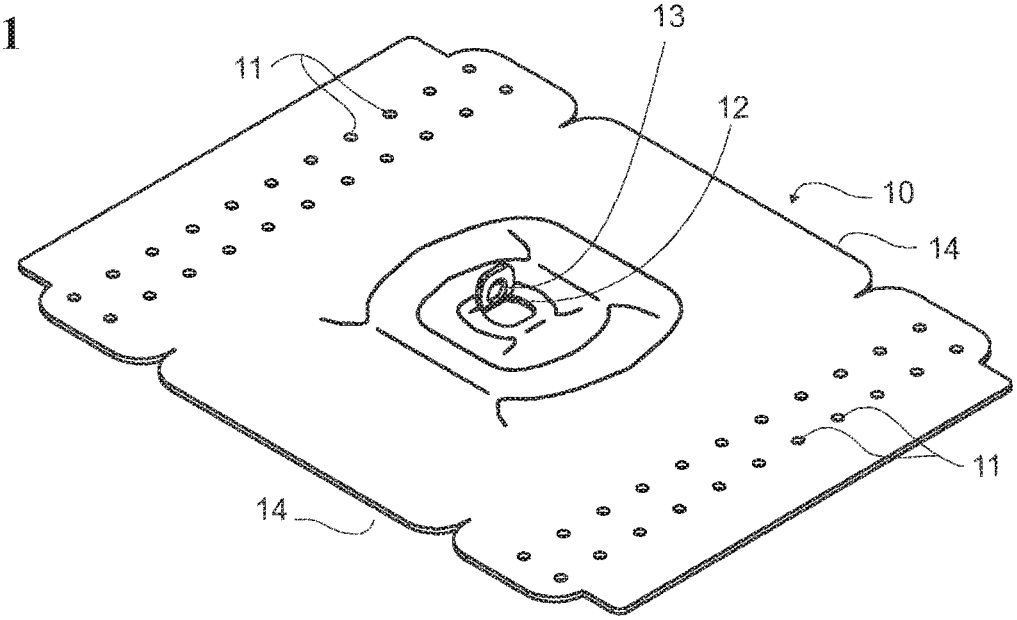
FIG. 1 shows a perspective view from above of an exemplary foot plate for a fall protection according to the invention, wherein the innermost pivot region is bent upwards.

In FIG. 1, the innermost pivot range 13 is shown in an upwardly pivoted position, in order to illustrate the functioning of the fall protection device. This upwardly pivoted position is achieved, when in the load case, the post is loaded via tensile load acting onto its upper end, such that a leverage is generated, which causes the post to tilt down into an approximately horizontal position. This is possible because the lower end of the post is fixed in the area of the through hole 12 at the foot plate 10. As soon as the leverage acts from a certain direction, parallel towards the longitudinal edges 14 of the foot plate, as shown in FIG. 1, the innermost pivot range 13 is loaded to bending and pivots upwards into the position shown in FIG. 1, wherein the post itself is not shown here for the sake of a better overview. This pivoting upwards is allowed as the innermost pivot range 13 is separated from the remaining foot plate 10 by means of a circumferential slotted line 13*a*, which can be seen more clearly in FIG. 2 and which extends over the largest part of the periphery, for example over approximately 270°. Consequently, the innermost pivot range 13 is connected with the second innermost pivot range 15 only via a comparably narrow material web 13*b* (see FIG. 2).

Figure 2:
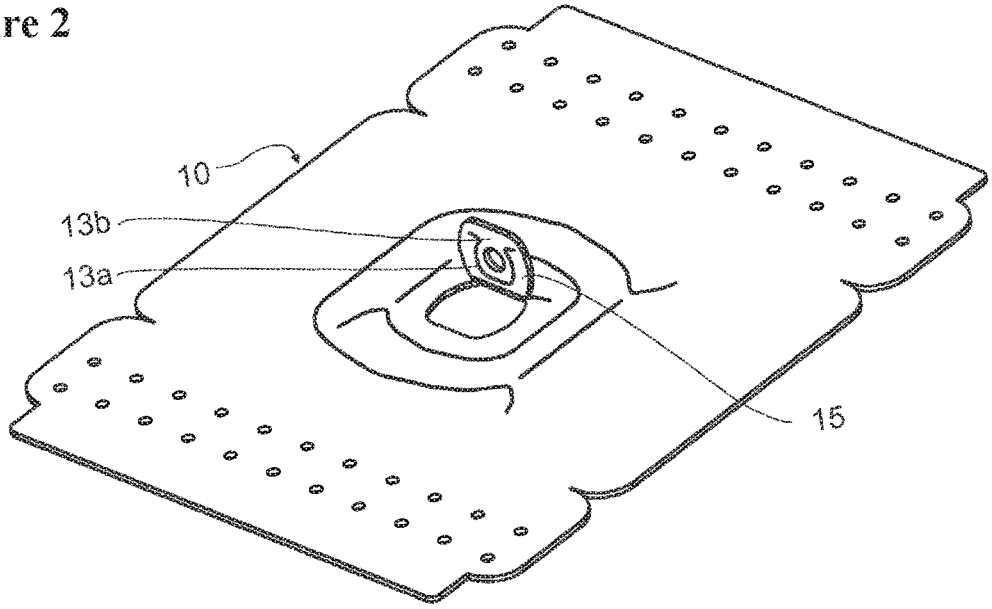
FIG. 2 shows a similar view of a foot plate from another perspective, wherein in this case, the second innermost pivot range is bent upwards.

In FIG. 2, the second innermost pivot range 15 is bent upwards, which occurs when the leverage acts from a direction which is offset by approximately 90° to the direction as shown in FIG. 1. The second innermost pivot range 15 is also circumferentially surrounded by a circumferential slotted line 15*a*, which can be seen in FIG. 3. Thus, a large area of the second innermost pivot range 15 is separated from the third pivot range 16 surrounding it. Differently from the innermost pivot range 13, here, even an additional straight slotted line 15*c* is provided, which extends in the lower area between the two limbs of the omega shape of the circumferential slotted line 15*a*, in the area where these two limbs are closest to one another, wherein, however, a narrow material web 15*b* remains on each of the two sides between the straight slotted line 15*c* and the circumferential slotted line 15. These two material webs practically form the joint, if the post tilts down and the pivot range 15 is bent up, as shown in FIG. 2.

Figure 3:
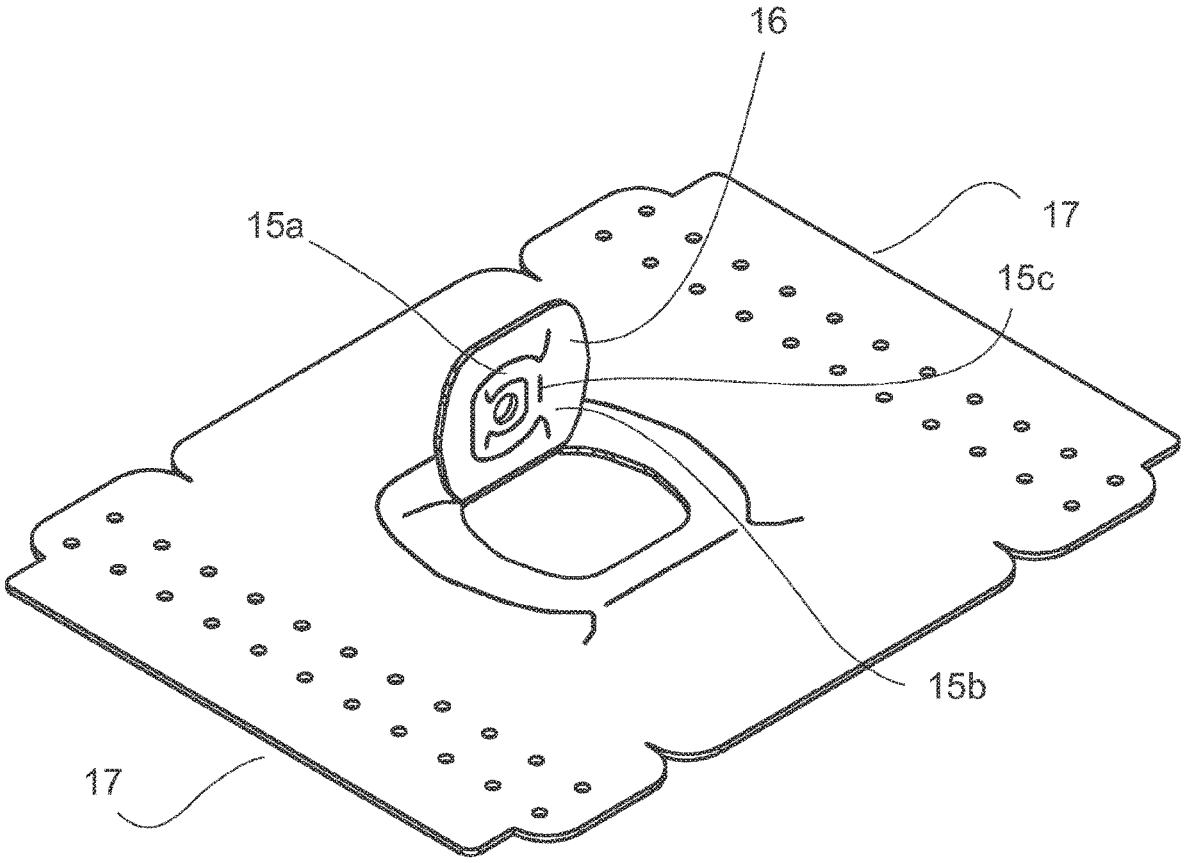
FIG. 3 shows a similar view of a foot plate from the same perspective as in FIG. 2, wherein in this case, however, the third pivot range is bent upwards.

Comparing the two FIGS. 2 and 3, it can be seen that in FIG. 2, the second innermost pivot range 15 pivots upwards, if the leverage acts by approximately 90° offset, as compared to the action of the leverage shown in FIG. 3, wherein the leverage is effected approximately parallel to the two transverse edges 17 of the foot plate.

Figure 4A:
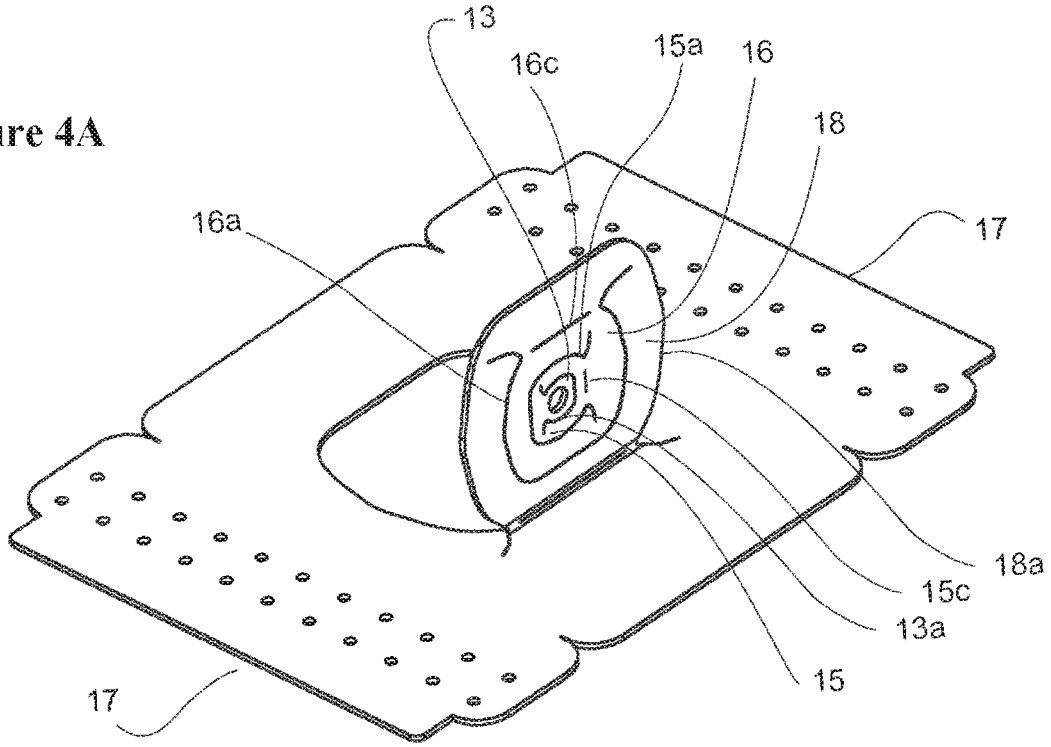
FIG. 4 a shows a similar view of a foot plate from the same perspective as in FIG. 3, wherein in this case, however, the outermost pivot region is bent upwards.
FIG. 4*b* shows a further view of the foot plate seen from the other side than in FIG. 4*a*, wherein here also the outermost pivot region is bent upwards.

FIG. 4*a*, finally, shows a pivoting upwards of the outermost pivot range 18, which is also generated in case of a leverage acting approximately parallel towards the two transverse edges 17 of the foot plate, however, in an opposite direction (offset by 180°) as compared to FIG. 3. In the view according to FIG. 4, with the outermost pivot range 18 being pivoted upwards, it can also be clearly seen that the third pivot range 16, the second innermost pivot range 15 and the innermost pivot range 13 are all within the outermost pivot range 18, each separated from the other by circumferential slotted lines. Furthermore, it can be seen that each of the four circumferential slotted lines 18*a*, 16*a*, 15*a*, 13*a*, has a geometrically similar shape, namely approximately the form of a Greek Omega in this embodiment. In case of the three outermost pivot ranges there are each time additional straight slotted lines which extend at the periphery side, where no circumferential slotted line is provided, such that finally, a slotted line is provided nearly circumferentially, only interrupted by the two narrow material webs. In this case, FIG. 4 a shows that the two circumferential slotted lines 16*a* and 15*a*, being arranged one inside the other, of the second and the third pivot range, are arranged offset to one another by 90° and again offset towards the outermost circumferential slotted line 18*a*. Furthermore, the two straight slotted lines 16*c* and 15*c* of these two pivot ranges can be seen in FIG. 4*a* and it can also be seen that only one circumferential slotted line 13*a* is provided for the innermost pivot range, as in this case, the remaining material web between the ends of this circumferential slotted line is already comparably short and serves as a joint for the pivot movement of the innermost pivot range 13.

Figure 4B:
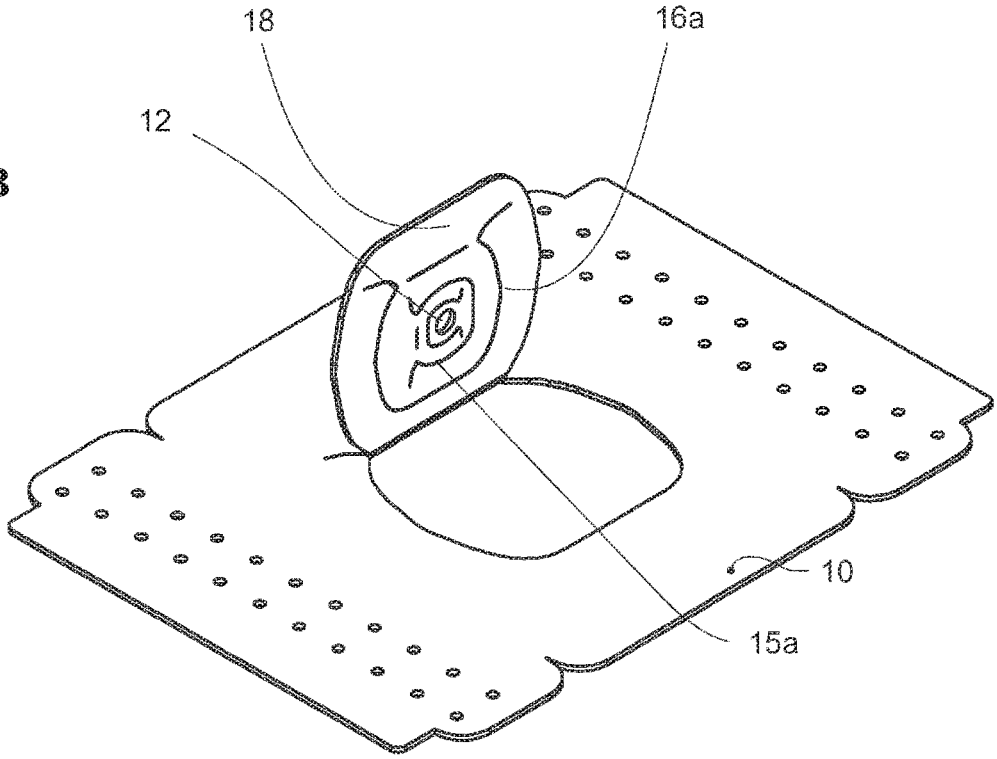

FIG. 4B shows basically the same pivot position as FIG. 4*a*, having an upwardly pivoted outermost pivot range 18, but from another perspective view, such that in FIG. 4*b*, the opening in the foot plate 10 can be seen, which is caused by the upwardly pivoting outermost pivot range upon tilting down the post in the load case.

Figure 5:
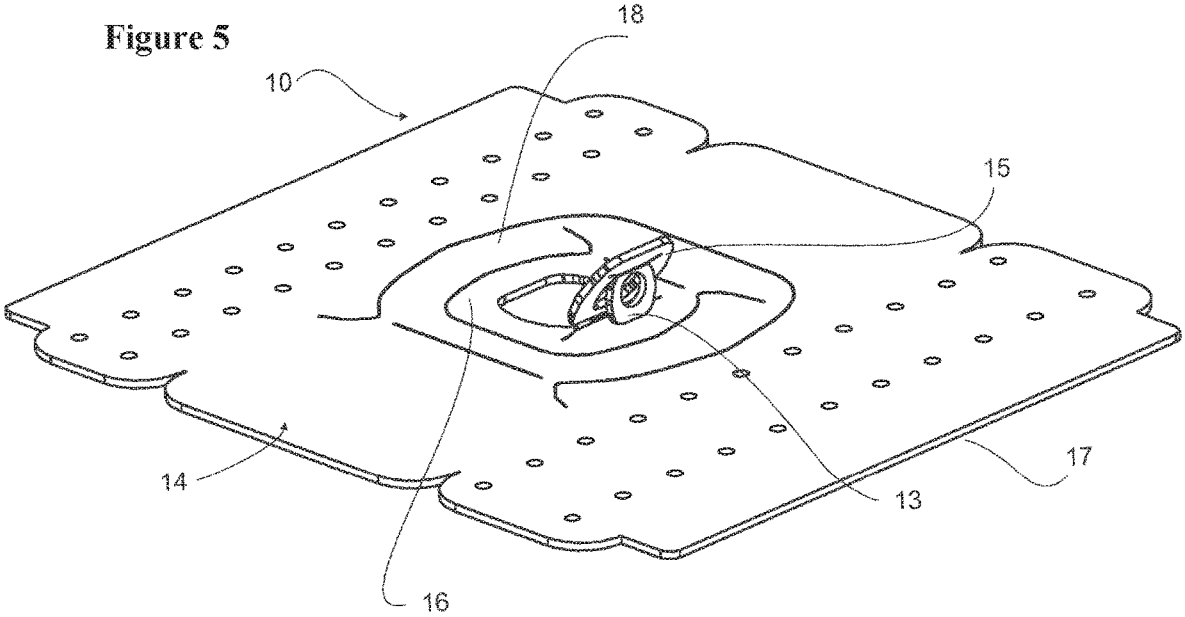
FIG. 5 shows a further view of a foot plate from another perspective, wherein in this case, two inner pivot ranges are bent upwards at the same time.

FIG. 5 shows a pivot position which is generated when the leverage is not acting exactly from a direction approximately parallel to one of the longitudinal edges 14 or transverse edges 17. In this case, more than one pivot range become active and in FIG. 5 it can be seen, that in this case, the innermost pivot range 13 as well as the second innermost pivot range 15 are pivoting upwards at least partly, while the two outermost pivot ranges 16 and 18 remain in their original position within the plane of the foot plate 10.

Figure 6:
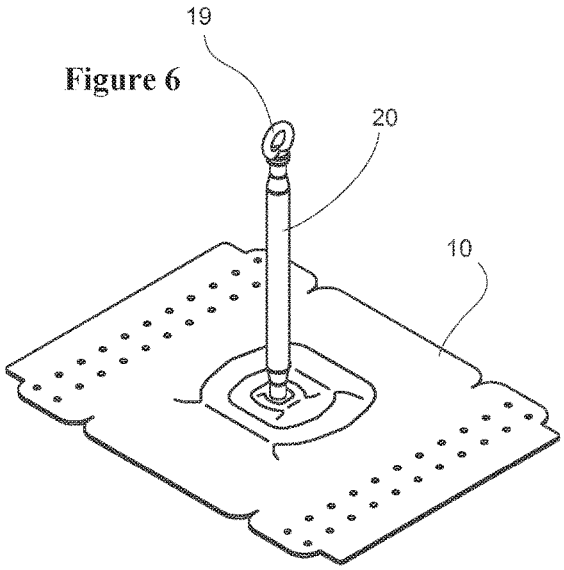
FIG. 6 shows a view of a post attached to the foot plate in upright position.
Figure 6A:
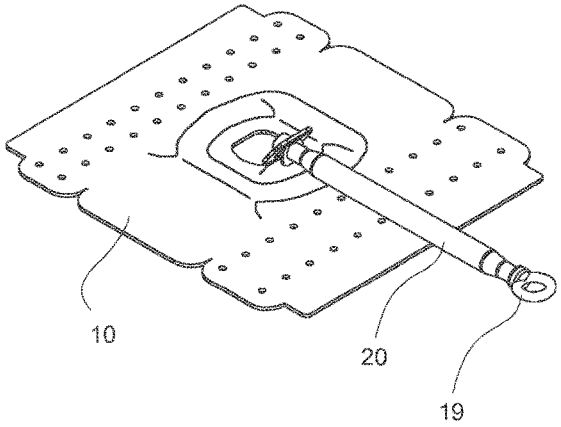
FIG. 6*a* shows a corresponding view of a post in the tilted down position after the load case has occurred.

In the following, it is referred to the FIGS. 6 and 6*a*, each of which in a perspective view shows a foot plate 10 of the above described kind, to which a post 20 for the fall protection is attached. As can be seen, in FIG. 6, the normal use position is shown, in which the post 20 stands upright. At the upper end of the post 20 an eyelet 19 is provided, for attaching for example a cable of the fall protection device. The lower end of the post 20 is attached to the foot plate 10, for example by means of a screwed connection. In FIG. 6*a*, it can be roughly seen that the post 20 pierces a central hole in the foot plate 10 and is with its bottom side attached for example via a nut to the foot plate. FIG. 6*a* shows the state after occurrence of the load case and it can be seen that the post 20 was tilted down into a horizontal position, which is possible as the corresponding pivot range pivots upwards with the lower end of the post by means of the tensile load. If the post is in the horizontal position according to FIG. 6*a*, no moment acts any longer on the foot plate 10, such that it, respectively the trapezoidal sheet to which it is attached, cannot tear off.

Figure 7:
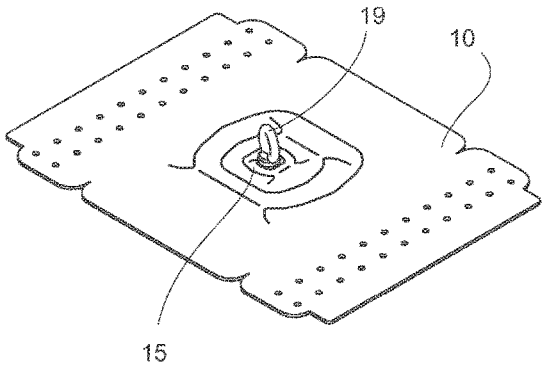
FIG. 7 shows an alternative embodiment, wherein an eyelet is attached directly at the foot plate.
Figure 7A:
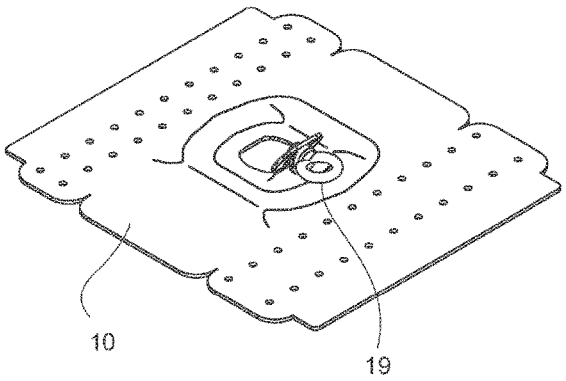

FIGS. 7 and 7*a* also show an alternative embodiment of the fall protection device in a perspective view, which works according to the same principle of the present invention. As a difference to the above described embodiment, in this case, the eyelet 19 is attached directly to the foot plate, such that not post is required in this case. The fall protection device can in this case be attached directly to the eyelet. The eyelet itself can be attached to the foot plate 10 for example by means of a threaded section on the bottom side and a nut by screwing or other suitable attachment means. When the load case occurs, firstly, a torque is generated, which causes a pivot movement of the pivot range of the foot plate 10, wherein the pivot range pivots with the eyelet into the unload position shown in FIG. 7. The functioning is thus even in case of this embodiment the same as in the embodiment described above according to FIG. 6, wherein in this specific example, the third pivot range 15 pivots upwards from outside. The question as to which pivot range is effective in which case depends on the respective direction from which the torque acts.

REFERENCE NUMERAL LIST

10 foot plate
11 bore holes
12 through hole
13 innermost pivot range
13*a* circumferential slotted line
13*b* material web
13 Longitudinal edges of the foot plate
15 second innermost pivot range
15*a* Circumferential slotted line
15*b* material web
15*c* straight slotted line
16 third pivot range
16*a* circumferential slotted line
16*b* material web
16*c* straight slotted line
17 transverse edges of the foot plate
18 outer pivot range
18*a* circumferential slotted line
18*b* material web
18*c* straight slotted line
19 eyelet
20 post

The invention claimed is:

1. A device for preventing persons from falling, in particular from a roof, comprising, a foot plate and either a post attached to the foot plate, the post having an eyelet arranged in the upper end region of the post, or the eyelet being attached directly at said foot plate, a cable which protects the person from falling, connected to the post or eyelet, the footplate having a central region to which said post or said eyelet is connected at least one first defined circumferential slotted line, extending around the central region which extends over at least approximately 270° in the circumferential direction, such that the central region is connected with a remaining peripheral region of said foot plate solely by narrow material webs said first circumferential slotted line extending over approximately 270° in the circumferential direction, a generally straight slotted line arranged between respective ends of said first circumferential slotted line, wherein the distance between said first circumferential slotted line and said straight slotted line corresponds to the width of said narrow material webs.

2. A device for securing persons against falling according to claim 1, positioned within a radial distance of said first defined circumferential slotted line at least one second circumferential slotted line with a smaller diameter the shape of the at least one second circumferential line is geometrically similar to said first circumferential slotted line in a plan view, said second circumferential slotted line is disposed generally 90° or generally 180° offset to said first circumferential slotted line.

3. A device for securing persons against falling according to claim 2, comprising, within said second defined circumferential slotted line at least one third circumferential slotted line with a smaller diameter is disposed within said second defined circumferential slotted line, the shape of the at least one third slotted line is geometrically similar to said first circumferential slotted line, wherein in a plan view, however, said at least one third circumferential slotted line is offset by approximately 90° or approximately 180° to at least one of said first circumferential slotted line and said second circumferential slotted line.

4. The device for securing persons against falling according to claim 3 comprising at least one fourth circumferential slotted line is disposed within the radius of the third slotted line a smaller diameter, the shape of the fourth slotted line is geometrically similar to said third circumferential slotted line in a plan view, however, said fourth circumferential slotted line is offset approximately 90° or approximately 180° offset to at least one of said first circumferential slotted line and said second circumferential slotted line and said third circumferential slotted line.

5. The device for securing persons against falling according to claim 3, wherein at least one of said first and said second and said third and said fourth circumferential slotted line have approximately a peripheral shape of an omega.

6. The device for securing persons against falling according to claim 3 the peripheral shape of at least one of said first and said second and said third and said fourth circumferential slotted line is defined by a sequence of lined-up, straight sub sections, being disposed at an angle to one another, according to the principle of Mohr's circle of stress.

7. The device for securing persons against falling according to claim 3 wherein said circumferential slotted lines and said straight slotted lines are formed in said foot plate by means of a laser beam or a high-pressure water jet.

8. The device for securing persons against falling according to claim 1 wherein at least one of the generally straight slotted line and the second circumferential slotted line and the third circumferential line are arranged in a distance between the respective ends of each of said circumferential slotted lines, wherein the distance between the respective ends of each of said circumferential slotted lines and the respective straight slotted line corresponds to the width of the narrow material webs.

9. The device for securing persons against falling according to claim 1 wherein the post or the eyelet is connected by screw threads with said foot plate.

10. The device for securing persons against falling according to claim 1 the foot plate is screw-connected with a trapezoidal metal sheet of the roof construction.

11. The device for securing persons against falling according to claim 1 wherein the foot plate is made of stainless steel and has a material thickness of approximately 3 to 5 mm.

12. The device for securing persons against falling according to claim 1 wherein the post or said eyelet has an outer thread within an end region facing the roof and said post or said eyelet can be fixed to said foot plate by a nut which screwed onto the outer thread.

* * * * *